US008161603B2

(12) United States Patent
Park et al.

(10) Patent No.: US 8,161,603 B2
(45) Date of Patent: Apr. 24, 2012

(54) HINGE

(75) Inventors: Sang-Ho Park, Changwon (KR); Ki-Hoon Song, Changwon (KR); Kil-Seok Jeong, Changwon (KR); Jeong-Ho Shin, Changwon (KR)

(73) Assignee: LG Electronics Inc., Seoul (KR)

( * ) Notice: Subject to any disclaimer, the term of this patent is extended or adjusted under 35 U.S.C. 154(b) by 342 days.

(21) Appl. No.: 12/522,852

(22) PCT Filed: Aug. 20, 2007

(86) PCT No.: PCT/KR2007/003976

§ 371 (c)(1),
(2), (4) Date: Jul. 30, 2009

(87) PCT Pub. No.: WO2008/084903

PCT Pub. Date: Jul. 17, 2008

(65) Prior Publication Data

US 2010/0000046 A1 Jan. 7, 2010

(30) Foreign Application Priority Data

Jan. 12, 2007 (KR) ..... 10-2007-0003930

(51) Int. Cl.
*E05D 11/06* (2006.01)

(52) U.S. Cl. ..... 16/357; 16/308; 16/303

(58) Field of Classification Search ..... 16/303, 16/330, 306, 308, 316, 328, 357, 358–360; 312/138.1, 405, 326, 327, 328, 329, 139; 220/834–838, 811

See application file for complete search history.

(56) References Cited

U.S. PATENT DOCUMENTS

| | | | | |
|---|---|---|---|---|
| 4,215,449 | A * | 8/1980 | Loikitz | 16/50 |
| 5,600,868 | A * | 2/1997 | Tourville et al. | 16/277 |
| 5,628,089 | A * | 5/1997 | Wilcox et al. | 16/303 |
| 5,682,644 | A * | 11/1997 | Bohacik et al. | 16/284 |
| 6,530,121 | B2 * | 3/2003 | Hayashi | 16/330 |
| 2004/0211211 | A1 * | 10/2004 | Nam et al. | 62/440 |
| 2005/0091794 | A1 | 5/2005 | Kang | |
| 2005/0108853 | A1 * | 5/2005 | Lee | 16/330 |
| 2005/0193523 | A1 * | 9/2005 | Nam et al. | 16/330 |
| 2006/0112516 | A1 * | 6/2006 | Chen et al. | 16/330 |
| 2007/0089273 | A1 * | 4/2007 | Kang | 16/330 |

FOREIGN PATENT DOCUMENTS

| | | | |
|---|---|---|---|
| JP | 2003-3738 | A | 1/2003 |
| KR | 20-0424971 | Y1 | 8/2006 |

* cited by examiner

*Primary Examiner* — Chuck Y. Mah

(74) *Attorney, Agent, or Firm* — Birch, Stewart, Kolasch & Birch, LLP

(57) ABSTRACT

A hinge according to the present invention includes: a housing; a shaft received in the inside of the housing; a guide member linearly moving along the shaft; and a first elastic member compressed and expanded along the movement of the guide member, wherein any one of the guide member and the housing is formed with a track groove and the other is formed with a guide projection moving the track groove and, the track groove is formed to move the guide projection to different paths according to a forward rotation and a reverse rotation of the shaft.

18 Claims, 6 Drawing Sheets

[Fig. 1]
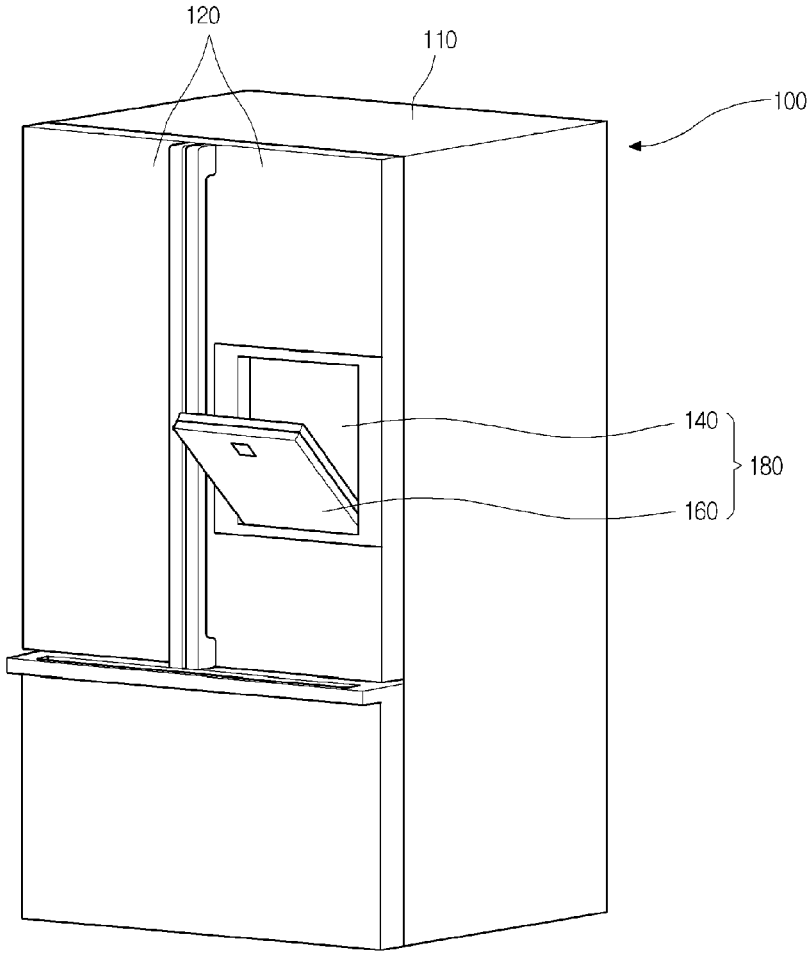
[Fig. 2]
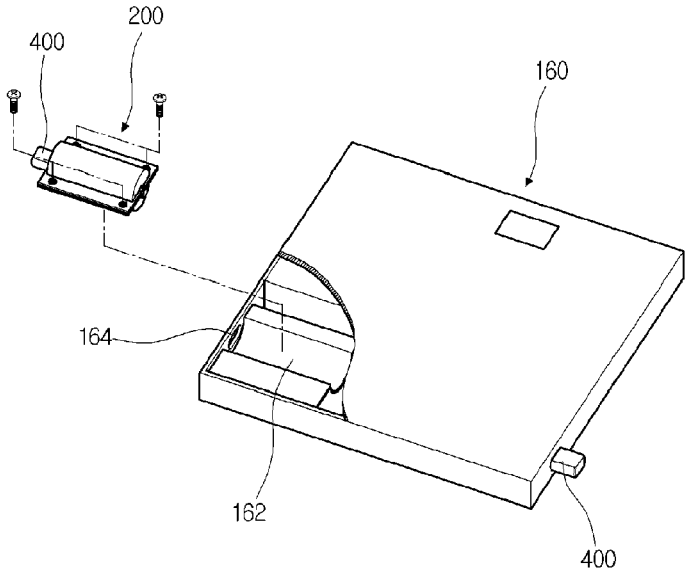

[Fig. 3]
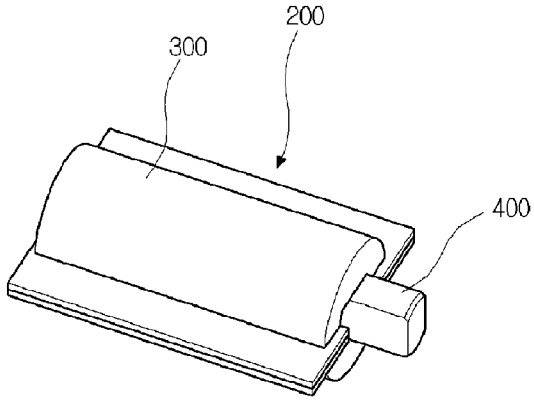
[Fig. 4]
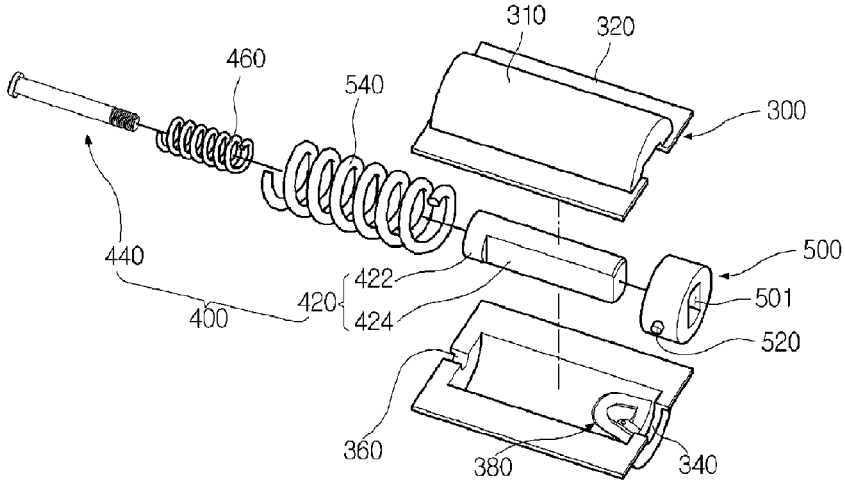
[Fig. 5]
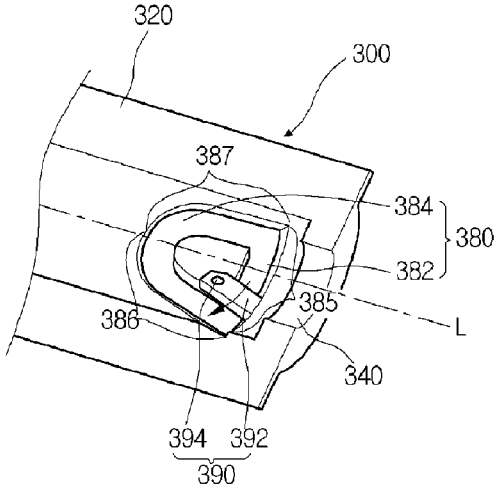

[Fig. 6]
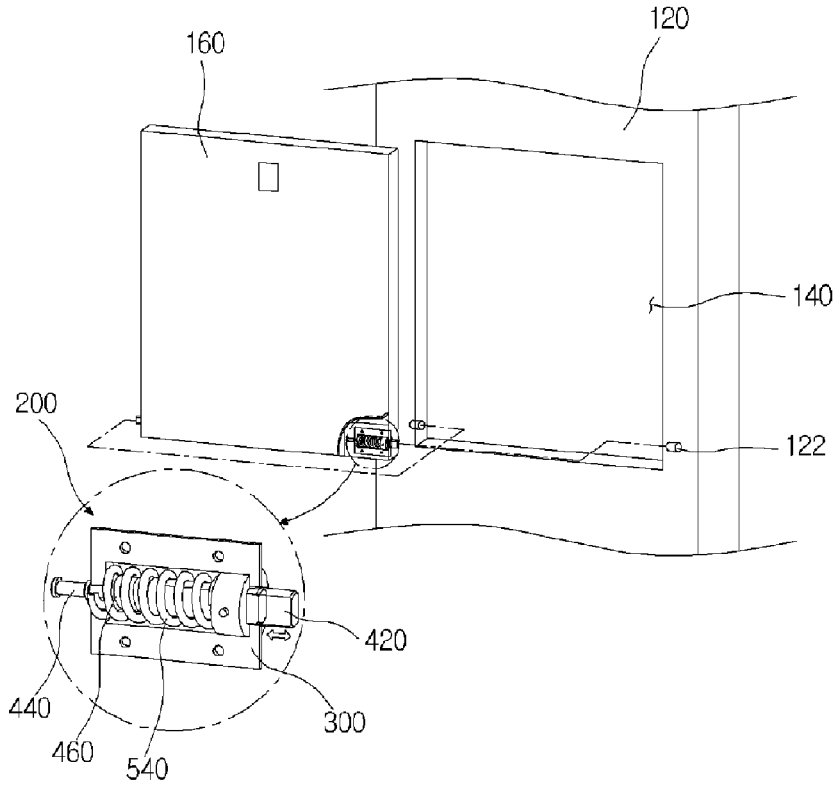
[Fig. 7]
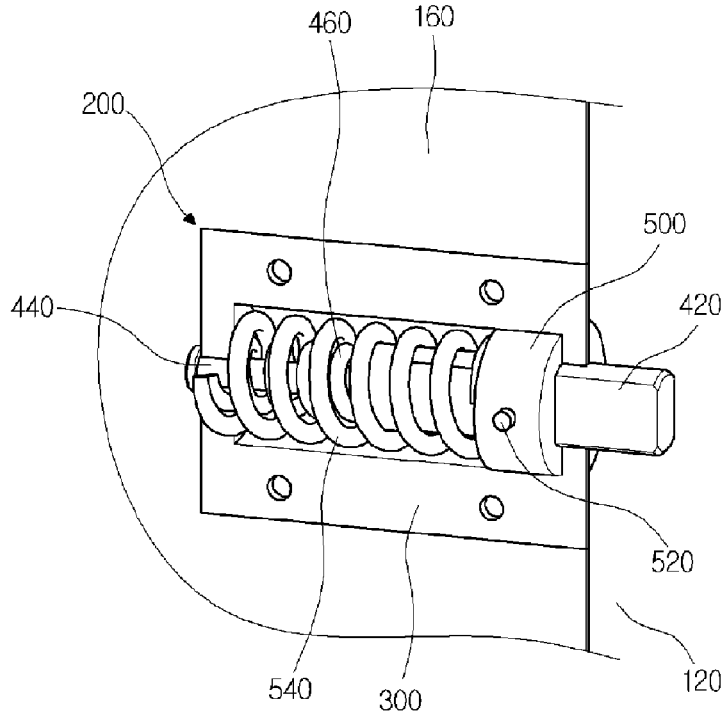

[Fig. 8]
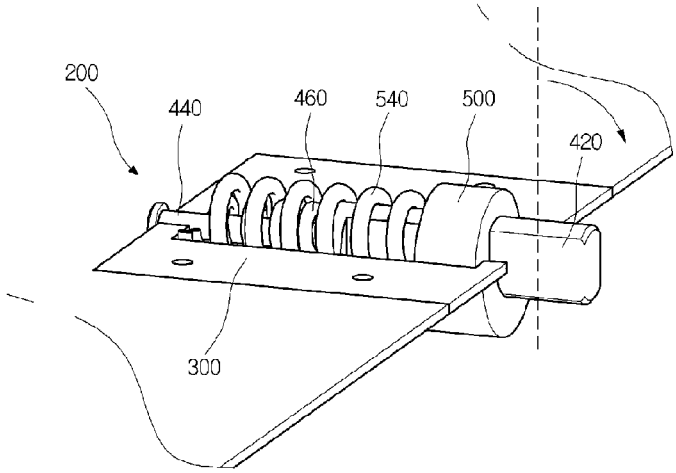
[Fig. 9]
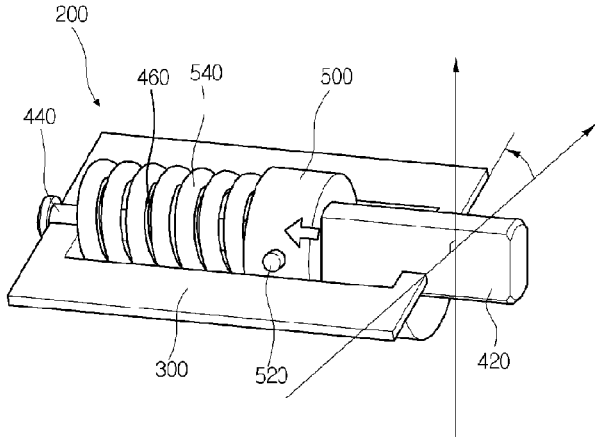
[Fig. 10]
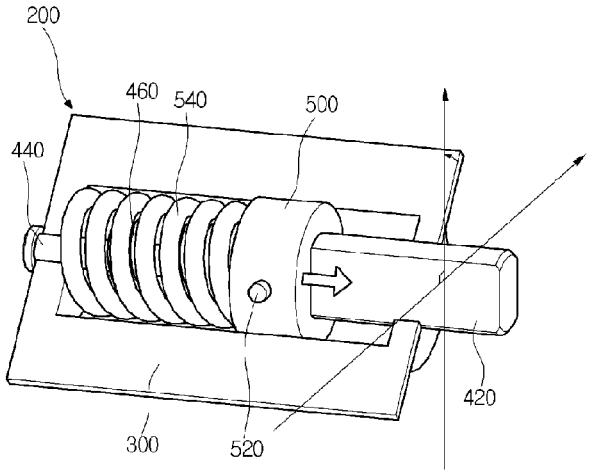

[Fig. 11]
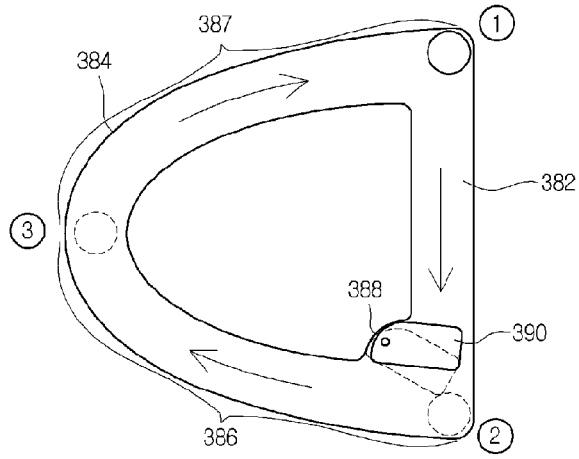
[Fig. 12]
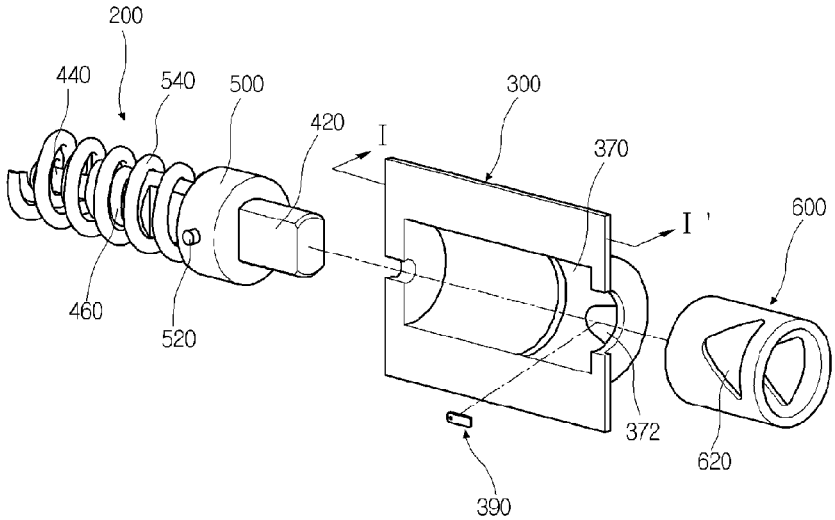
[Fig. 13]
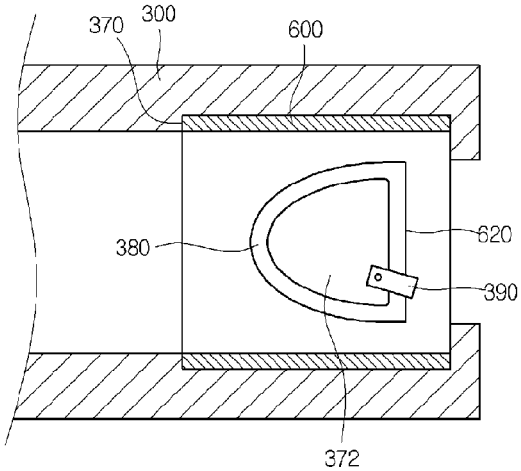

[Fig. 14]
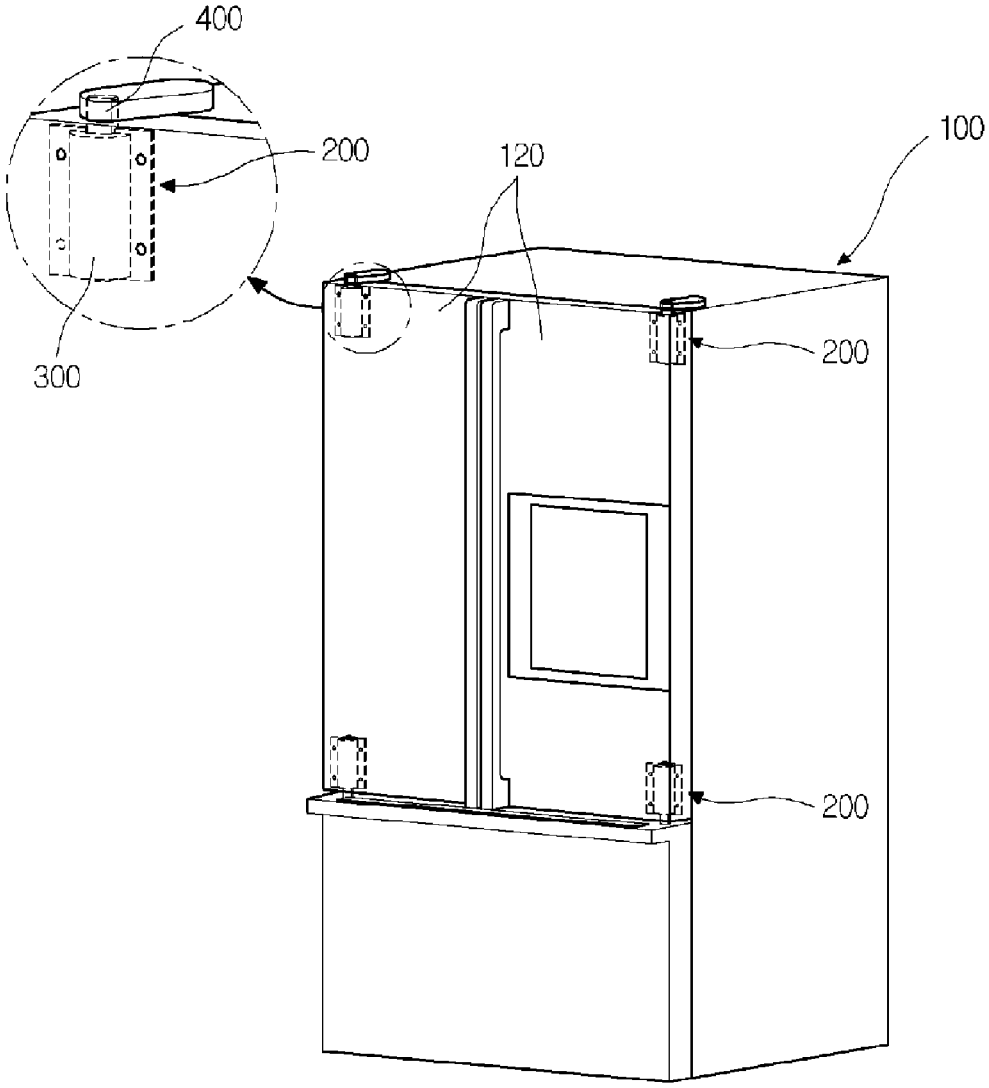

HINGE

TECHNICAL FIELD

The present invention relates to a hinge.

BACKGROUND ART

Generally, the hinge is an apparatus connecting a rotary body to a body on which the rotary body is supported, the hinge being an apparatus allowing the rotary body to be rotated from the body by means of force applied to the rotary body.

Generally, such a hinge is constituted to be able to be rotated with the rotary body by means of a simple shaft coupling. In such a constitution, a rotating operation opening the rotary body such as a door and a rotating operation closing the rotary body, respectively, should be performed. Specially, in order to close the rotary body, the same force as required to open the rotary body should be applied to the rotary body.

Such repetitive operations cause a user inconvenience. In some cases, the situation where the user is hard to perform the repetitive operations occurs. Therefore, separately from the hinge, an apparatus that the rotary body such as the door is further provided with an auto-closing apparatus that automatically returns the rotary body to be able to be closed has been proposed. As an example, Korean Laid-Open Patent No. 10-2005-0097736 disclosed a hinge for a door having an auto closing function allowing the door to be able to be automatically closed when removing external force.

However, the conventional hinges having such a constitution generates compressive force when performing a rotary operation for opening the door and then the door is rotated by means of restoring force corresponding to the generated compressive force so that it is closed.

Therefore, in order for the door to be automatically closed, the user should necessarily apply force capable of generating the compressive force when opening the door, thereby causing the problem that the opening work of the door is inconvenient.

And, when the door is automatically closed by means of the force corresponding to the compressive force, a separate damping apparatus or a damping structure should be provided so as not to apply an impact on the door.

DISCLOSURE OF INVENTION

Technical Problem

However, it has the problems that when the constitution for the damping is further provided, it is difficult to rapidly open and close the door due to resistance of oil as well as large force is required to open the door so that it causes the user inconvenience in some cases.

The present invention is to solve the problems as above. It is an object of the present invention to provide a hinge constituted to generate elastic force by means of a rotating operation in a constant section during a reverse rotation so that it is automatically rotated by means of the elastic force in the residual reverse rotation section.

It is another object of the present invention to provide a door provided with a hinge capable of completely a rotary body using accumulated energy by a rotating operation in a constant section.

Technical Solution

There is provided a hinge according to the present invention for accomplishing the objects, including: a housing; a shaft received in the inside of the housing; a guide member linearly moving along the shaft; and a first elastic member compressed and expanded along the movement of the guide member, wherein any one of the guide member and the housing is formed with a track groove and the other is formed with a guide projection moving the track groove and the track groove is formed to move the guide projection to different paths according to a forward rotation and a reverse rotation of the shaft.

There is provided a hinge according to another aspect of the present invention, including: a housing fixed in any one of a rotating object and a body coupled with the rotating object; a shaft received in the inside of the housing, a part of the shaft being projected to be inserted in the other one of the rotating object and the body; a guide member inserted in an outer circumference of the shaft to make a linear motion in an opening and closing process of the rotating object; and an elastic member inserted inside the housing and expanded and contracted in the opening and closing of the rotating object.

There is provided with a hinge according to further aspect of the present invention, including; a housing; a shaft received in the inside of the housing; a guide member moving along the shaft and having a guide projection projected on an outer circumferential surface thereof; an elastic member compressed and expanded according to the movement of the guide member; and a guide ring mounted in an inner circumferential surface of the housing and having a perforating part formed therein for receiving the guide projection, the inner circumferential surface of the housing being formed with a projecting part received in the inside of the perforating part and formed with a track groove guiding the movement of the guide projection.

Advantageous Effects

With the hinge as above, it has an effect that force is applied up to be completely opened in a rotation (forward rotation) for opening the rotary body such as the door, however, even when force is applied only up to a constant section in a rotation (reverse rotation) for closing the rotary body, the rotary body is automatically closed.

Accordingly, the rotary body can more easily be opened without applying external force for compressing oil or gas as in the conventional door having a separate auto closing apparatus, making it possible to improve convenience of use.

Also, the hinge according to the present invention has an effect that the shaft is disengaged from the body in the state where it is inserted in the body supporting the hinge by means of a spring member pushing the shaft.

In other words, the process mounting the door provided with the hinge into the body is easily made so that service ability and assembling workability are improved.

BRIEF DESCRIPTION OF THE DRAWINGS

FIG. 1 is a perspective view showing an external appearance of a refrigerator adopting a hinge according to the present invention.

FIG. 2 is an exploded perspective view showing an appearance of the hinge according to the present invention mounted in a home bar door.

FIG. 3 is a perspective view showing the external appearance of the hinge according to the present invention.

FIG. 4 is an exploded perspective view showing a constitution of the hinge according to the present invention.

FIG. 5 is a perspective view showing an inside of a housing that is main component of the hinge according to the present invention.

FIG. 6 is a view showing an appearance of the hinge according to the present invention mounted in a home bar door of a refrigerator.

FIG. 7 is a perspective view showing the inner state of the hinge in the state where the home bar door is closed.

FIG. 8 is a perspective view showing the inner state of the hinge in the state where the home bar door is completely opened.

FIG. 9 is a perspective view showing the inner state of the hinge when applying force in a constant section in order to close the home bar door.

FIG. 10 is a perspective view showing the inner state of the hinge after removing force applied to the home bar door.

FIG. 11 is a schematic view showing a moving path of a guide projection according to an opening and closing process of the home bar door.

FIG. 12 is an exploded perspective view of the hinge according to another embodiment of the present invention.

FIG. 13 is a cross-sectional view taken along I-I of FIG. 12, the state where a guide ring is safely positioned in the housing being shown.

FIG. 14 is a perspective view schematically showing an appearance adopted the door provided with the hinge in the refrigerator.

MODE FOR THE INVENTION

Reference will now be made in detail to specific embodiments, examples of which are illustrated in the accompanying drawings. However, the scope of the present invention is not limited to the disclosed embodiments and other embodiments or other retrogressive inventions covered by the scope of the present invention can easily be made by means of addition, change, removal, etc., of other components.

A hinge according to the present invention can be mounted in various kinds of doors; however, an example that the hinge is applied to a home bar of a refrigerator for convenience of explanation will be described below.

FIG. 1 is a perspective view showing an external appearance of a refrigerator adopting a hinge according to the present invention and FIG. 2 is an exploded perspective view showing an appearance of the hinge according to the present invention mounted in a home bar door.

Referring to FIGS. 1 and 2, a body 110 of a refrigerator 100 is formed in an approximately rectangular parallelepiped shape and the inside thereof is formed to be partitioned into a cooling compartment and a freezing compartment. And, the opened front of the body 110 of the refrigerator is rotatably provided with a door 120 of the refrigerator. Specifically, the door 120 of the refrigerator is to selectively shield the cooling compartment and the freezing compartment, respectively, and is constituted to be selectively shielded by means of a rotation or to selectively shield the cooling compartment and the freezing compartment by being drawn in/out in a drawer manner.

Meanwhile, the front of the door 120 of the refrigerator is provided with a home bar 180 depending on the products.

Specifically, the home bar 180 with a predetermined size is provided in the inside of the door of the cooling compartment or the freezing compartment and is to accommodate food such as drinking water or other vessels, which are frequently drawn out or received from/in there. The food or vessel frequently drawn out/in is accommodated in the inside of the home bar 180 so that the door of the freezing compartment or the cooling compartment need not open in order to draw out them. As a result, as the loss of cool air reduces, power consumption reduces.

More specifically, the home bar 180 is constituted by an opening part 140 formed in a predetermined shape on one side of the front of the door 120; and a home bar door 160 rotatably coupled to one side edge of the opening part to selectively open and close the opening part 140.

The home bar door 160 is formed in a shape corresponding to the opening part 140 to be able to shield the opening part 140. And, it is hinge-coupled to one side edge of the opening part 140 to be able to selectively shield the opening part 140 by means of the rotation.

The hinge 200 is fixed in the left inside and the right lower end of the home bar door 160. The leading end of the shaft 400 as will be described below is projected from both sides of the home bar door 160 to be inserted into the edge of the opening part 140.

Also, the inside of the home bar door 160 is formed with a mounting part 1602 for receiving the hinge 200, wherein the mounting part 1620 is formed in a shape corresponding to the shape of the housing 300. And, the lower of the home bar door 160 is formed with a shaft hole 164 to allow the end of the shaft 400 to be projected outside.

And, the shaft 400 projected to both sides of the home bar door 160 is inserted in the edge surface of the opening part 140 so that the home bar door 160 is formed to be able to be rotated about the shaft 400.

Hereinafter, the hinge will be described in more detail with reference to the accompanying drawings.

FIG. 3 is a perspective view showing the external appearance of the hinge according to the present invention and FIG. 4 is an exploded perspective view showing a constitution of the hinge according to the present invention.

Referring to FIGS. 3 and 4, the hinge 200 according to the present invention includes the housing 300 forming an external appearance: the shaft 400 received in the inside of the housing 300; a guide member 500 inserted into the outer circumferential surface of the shaft 400 and making a linear motion in a rotating process of the home bar door 160; and an elastic member fitted in the outer circumference of the shaft 400.

Specifically, the housing 300 forms the outer appearance of the hinge 200 and is formed in a cylindrical shape having a predetermined diameter. And, the inside thereof is constituted by a receiving part 310 receiving various components, including the guide member and the elastic member; and a coupling part 320 extended from the edge of the receiving part 310. And, the coupling part 320 is formed with a plurality of connecting holes and the hinge 200 is fixed in the home bar door 160 by means of a connecting member penetrating through the connecting hole.

Meanwhile, the housing 300 is divided into an upper housing and a lower housing to be able to mount a plurality of parts in the inside thereof, wherein the upper and lower housings is integrally coupled by means of the connecting member penetrating through the coupling part 320.

And, one side end of the housing 300 is formed with a first through-hole 340 through which the one end of the shaft 400 is penetrated to be exposed outside and the other side end thereof is formed with a second through-hole 360 through which the other end of the shaft 400 is penetrated to be exposed. In the drawings, the first through-hole 340 is formed the right surface of the housing 300 and the second through-hole 360 is formed the left surface thereof.

Also, the inner circumferential surface of the housing 300 is further provided with a track groove 380. The track groove 380 guides the movement of the guide member when the housing 300 is rotated about the shaft 400. The detail constitution and function thereof will be below described in more detail.

Meanwhile, as shown in FIG. 4, the inner side of the housing 300 is provided with the shaft 400. The shaft 400 enables the home bar door 160 to be axis-coupled to the edge of the edge of the opening part 140. And, the shaft 400 is formed in a round bar shape and is constituted by a main shaft 420 and a sub shaft 440.

Specifically, the main shaft 420 is mounted in the right inside of the housing 330 as shown in the drawing to allow the home bar door to be rotatably coupled to the opening part 140. And, the one end of the main shaft 420 penetrates through the first through-hole 340 of the right side of the housing 300 to be inserted into the door 120 of the refrigerator formed with the opening part 140.

Also, the main shaft 420 is constituted by a supporting part 422 and a guide part 424. The supporting part 422 is formed in a predetermined width from the one side end (left end in the drawing) of the main shaft 420 and forms a cross section of a circular shape. And, the supporting part 422 supports the front end of the second elastic member 460 as will be described below and can compress the second elastic member 460 according to the operation of the user. The second elastic member 460 is compressed and expanded in the coupling process to allow the one end of the hinge 200 to be inserted into the door 120 of the refrigerator.

Also, the guide part 424 is expanded from a point where the supporting part 422 is terminated to the other side end (right end in the drawing) of the main shaft 420. Specifically, the guide part 424 is a part that the left and right sides of the shaft in the round bar shape are chamfered and is formed in a flat key shape as a whole. And, the outer circumferential surface of the guide part 424 is inserted with the guide member 500 and the guide member 500 is advanced and retreated along the guide part 424 in the opening and closing process of the home bar door 160.

Meanwhile, the rear end (left end in FIG. 4) of the main shaft is mounted with the sub shaft 440.

Specifically, the sub shaft 440 is coupled to the main shaft 420 in the rear of the main shaft 420 to restrict the main shaft 420. And, the sub shaft 440 is formed in a round bar shape having smaller diameter than the main shaft 420. And, the left end is formed to have a slightly large diameter such as a head shape of a bolt and the right end is formed with a thread to be screw-coupled to the rear end of the main shaft 420. Herein, it should be recognized that the sub shaft 440 is separately formed from the main shaft 420 to be able to be screw-coupled, however, can be integrally formed with the main shaft 420.

And, the sub shaft 440 is inserted by penetrating through the second through-hole 360 of the left surface of the housing 300 and is coupled to the rear end of the main shaft 420 by penetrating through the second elastic member 460 from the inner side of the housing 300.

Also, the elastic member mentioned above is provided with a first elastic member 540 and a second elastic member 460.

Specifically, the first elastic member 540 is fitted in the outer circumference of the main shaft 420 and the one end thereof closely attaches the guide member 500 and the other end thereof closely attaches the left inner circumferential surface of the housing 300. And, the second elastic member 460 is fitted in the outer circumference of the sub shaft 440 and the one end thereof closely attaches to the supporting part 422 of the main shaft 420 and the other end thereof closely attaches to the left inner circumferential surface of the housing 300. Herein, the left inner circumferential surface of the housing 300 is referred to as an opposite surface to the surface to which the guide member 500 closely attaches, if viewed from FIG. 4.

More specifically, the first elastic member 540 and the second elastic member 460 are formed of a tension spring having predetermined elastic force. Accordingly, the right end of the main shaft 420 penetrates through the right side of the housing 300 to be projected by means of the elastic force of the second elastic member 460. And, if a fabricator presses the projecting part of the shaft in order to couple the hinge 200, the second elastic member 460 is compressed and the projecting part is inserted into the inside of the housing 300.

Also, the first elastic member 540 is compressed and expanded according to an axial movement of the guide member 500. And, the axial movement of the guide member 500 is made in the opening and closing process of the home bar door 160.

Specifically, the guide member 500 moves to the left or the right of the main shaft 420 according to the rotation of the home bar door 160 to compress or expend the first elastic member 540. And, the central of the guide member 500 is formed with a through-hole 501 having the same shape as the cross section of the guide part 424 forming a part of the main shaft 420. And, since the guide part 424 is formed in a non-circular shape, the guide member 500 can be moved only in an axis direction, but cannot be rotated about the main shaft 420.

Also, the outer circumferential surface of the guide member 500 is formed with the guide projection 520. The guide projection 520 is relatively moved along the track groove 380 formed on the inner circumferential surface of the housing 300. And, the two guide projections 520 are formed in an opposite direction to the outer circumferential surface of the guide member 500. And, the guide projection 520 is projected by a predetermined length in a diameter corresponding to the width of the track groove 380.

And, the first elastic member 540 is formed to have larger inner diameter than an outer diameter of the shaft 400 and the second elastic member 460 in order to receive them.

Meanwhile, the inner circumferential surface of the housing 300 to which the guide member 500 closely attaches is formed with the track groove 380. The detailed description thereof will be described below with reference to the drawings.

FIG. 5 is a perspective view showing an inside of a housing that is main component of the hinge according to the present invention.

Specifically, the one side of the housing 300 constituting the hinge 200 is formed with the track groove 380. The track groove 380 is formed along the inner circumferential surface of the housing 300 and is constituted by a first guide groove 382 and a second guide groove 384.

The first guide groove 382 is to guide the guide projection 520 when the home bar door 160 is opened (forward rotation). More specifically, the first guide groove 382 is formed along the inner circumference of the housing 300 in a vertical direction to the axis direction of the hinge 200. And, the length of the first groove 382 is formed by a distance from the state where the home bar door 160 is closed to the state where it is completely opened. In other words, during the housing 300 is rotated about 90°, the guide projection is formed by a rotating distance and is extendedly formed from the upper of the inner circumferential surface of the housing 300 to the lower thereof.

Also, both ends of the first guide groove 382 are connected to both ends of the second guide groove 384. The second guide groove 384 is a path guiding the guide projection when the home bar door 160 is closed (reverse rotation). Specifically, the second guide groove 384 is curved in the central direction of the housing 300, that is, in a shape projected in a left direction in the drawing.

The track groove 380 will be described in more detail based on the horizontal direction movement of the guide member 500.

First, when the home bar door is rotated in an opening direction, the housing 300 is rotated together. Then, the guide projection 520 formed in the guide member 500 is relatively moved along the first guide groove 382. Herein, the guide projection 520 moves along the first guide groove 382 by means of the rotation of the housing 300, but the guide member 500 maintains a stationary state. Accordingly, the first guide groove 382 is a stationary section 385 that maintains the stationary state of the guide member 500.

And, the one end of the stationary section 385 is connected to a compressing section 386. The compressing section 386 is a section to enable the guide member 500 to be moved along the main shaft 420.

Specifically, in the compressing section 386, the home bar door 160 is closed and at the same time, the guide member 500 is moved from right to left along the main shaft 420. And, the guide member 500 is moved and at the same time, the first elastic member 540 is compressed.

Also, the compressing section 386 is formed to be curved from the one end of the stationary section 385 to the left of the housing 300. At this time, the end of the compressing section 386 is positioned on a line L equally dividing the stationary section. And, if the guide member 500 is beyond the end the compressing section 386, the guide member 500 is back moved right. Herein, since the compressing section 386 is extendedly formed in the central direction of the housing 300, the first elastic member 540 is compressed when the guide projection 520 moves along the compressing section 386.

Meanwhile, a returning section is continued from the end of the compressing section 386. The returning section 387 is a section to allow the guide member 500 to be moved in a reverse direction along the main shaft 420. That is, in the returning section 387 the guide member 500 is moved from left to right.

The returning section 387 is extendedly formed from the end of the compressing section 386 to the other end of the stationary section 385 to be connected to the stationary section 385. Accordingly, if the compressing section 386 and the returning section 387 use an approximately central part of the stationary section 385 as a reference, they are formed to be symmetrical to each other. However, a lifting up section may be short or long in order to close the home bar door 160 according to the length of the compressing section 386. This can be achieved by properly modeling the shape of the second guide groove 384.

For example, if the point where the returning section 387 starts is positioned on the upper side of the line L equally dividing the stationary section 385, the home bar door 160 should be lifted up above 45° from a horizontal state. Conversely, if the point where the returning section 387 starts is positioned on the lower side of the line L equally dividing the stationary section 385, the home bar door 160 should be lifted up less than 45° from a horizontal state.

And, the returning section 387 is a section to allow the guide member to be linearly moved in the direction where the first elastic member 540 is expanded. Specifically, the guide projection 520 enters the returning section 387, the first elastic member 540 is restored by means of the elastic force unless there is no external force pressing the first elastic member 540. At this time, the guide projection 520 moves along the returning section 387 by means of the elastic force.

Specifically, the returning section 387 is formed to be curved along the inner circumferential surface of the housing 300 from the end of the compressing section 386 to the stationary section 385. Accordingly, if the guide projection 520 moves along the returning section, the housing is rotated in the direction where the home bar door 160 is closed, without applying separate external force to the home bar door 160.

The reason is that the guide member 500 can not perform the rotation motion and can perform only linear motion. Accordingly, if the guide member 500 moves along the returning section 387 with the shape where the guide projection 520 is curved without being seceded, the housing 300 should be rotated.

As such, the stationary section 385, the compressing section 386, and the returning section 387 are connected to form the track groove 387. That is, the first guide groove 382 and the second guide groove 384 constituting the track groove 380 are formed in a closed loop shape so that the guide projection 520 can continuously be moved within the track groove 380 according to the operation of the home bar door 160.

Meanwhile, the one side of the track groove 380 is further provided with a latch 390. The latch 390 is to guide the moving path of the guide projection 520 and guides the guide projection 520 to be moved in only one direction, within the track groove 380. In addition, in the opening process and the closing process of the home bar door 160 it guides the guide projection 520 to be moved along different paths. In other words, in the opening process of the home bar door 160 the guide projection 520 moves along the stationary section 385 and in the closing process of the home bar door 160 the guide projection 520 is guided to move along the compressing section 386 and the returning section 387.

Specifically, the latch 390 is mounted in the one end (lower end in FIG. 5) of the first guide groove 382. The latch 390 is mounted to be able to be rotated in only a clockwise (arrow direction shown in FIG. 5) from the end where the first guide groove 382 is terminated, so that when the home bar door 160 is rotated to be completely opened and is then closed (when making a reverse rotation), the guide projection 520 does not move along the first guide groove 382 again but moves along the second guide groove 384.

The latch 390 is constituted by a rotating lever 392 and a rotating axis 394, wherein the rotating lever 392 is formed to have a length capable of shielding the first guide groove 382 in a horizontal direction and is constituted to be axis-coupled by means of the rotating axis 394, its one end being positioned at a point seceded inwardly from the track groove 380.

At this time, the latch 390 is constituted to rotate in only the moving direction of the guide projection 520 so that when the guide projection 520 is moving, it is opened by means a rotation in a clockwise. And, the latch passes through the guide projection 520 and then returns to an original state by means of a built-in resilient body (not shown) so that it shields the first guide groove 382.

Meanwhile, the latch 390 is formed not to rotate in an anti-clockwise (viewed from FIG. 5) in the state where the first guide groove 382 is shielded and preferably, the rotation of the anti-clockwise is restricted by means of a raised part 388 (see FIG. 11) formed on the outer side of the track groove 380.

And, when the guide projection 520 is formed on both sides of the outer circumferential surface of the guide member 500, it is preferable that the track groove 380 is formed on both sides of the inner circumferential surface of the housing 300 to be able receive each guide projection 520. And, each of the track grooves 380 is provided with the latch 390, respectively.

As a changeable structure, the track groove 380 may be formed in the guide member 500. In this case, the guide projection 520 received in the track groove 380 is formed to be projected from the inner circumferential surface of the housing 300. And, the latch 390 is provided on the one side of the guide member 500.

FIG. 6 is a view showing an appearance of the hinge according to the present invention mounted in a home bar door of a refrigerator.

Referring to the FIG. 6, the home bar door 160 is mounted in the opening part 140 of the door 120 of the refrigerator. And, the lower of both sides of the home bar is provided with the hinge 200.

The hinge 200 is mounted so that the end of the shaft 400 is projected to both right and left sides of the home bar door 160, and the projected end of the shaft 400 can be inserted into the inner side by means of the operation of the user.

Specifically, when the projected end of the shaft 400 is pressed for mounting the home bar door 160, it is inserted into the inside of the home bar door 160. Here, the projected end of the shaft is the end of the main shaft 400.

More specifically, as the main shaft 420 is inserted into the inner side of the home bar door 160, the elastic member inside the housing 300 becomes a compressing state. And, the sub-shaft 440 coupled to the read end of the main shaft 420 is projected to the outer side of the housing 400.

Therefore, if the shaft 400 is completely inserted into the inner side of the home bar door 160, the home bar door 160 becomes a state capable of being inserted into the inner side of the opening part 140. And, if the home bar door 160 is fittedly inserted into the opening part 140, the main shaft 420 is projected from the side of the home bar door 160 by means of the elasticity of the second elastic member 460 to be inserted into the coupling hole 122 formed at the edge of the opening part 140.

That is, as the one end of the main shaft 420 is inserted into the coupling hole 122, the home bar door 160 is axis-coupled to the opening part 140. And, the housing 300 coupled to the home bar door 160 is rotated together according to the rotation of the home bar door 160. And, the main shaft 420 is fixed in the state fitted in the coupling hole 122 to be maintained in a fixed state regardless of the rotation of the home bar door 160.

FIG. 7 is a perspective view showing the inner state of the hinge in the state where t he home bar door is closed, FIG. 8 is a perspective view showing the inner state of the hinge in the state where the home bar door is completely opened, FIG. 9 is a perspective view showing the inner state of the hinge when applying force in a constant section in order to close the home bar door, FIG. 10 is a perspective view showing the inner state of the hinge after removing force applied to the home bar door, and FIG. 11 is a schematic view showing a moving path of a guide projection according to an opening and closing process of the home bar door.

Hereinafter, the states of a guide member and an elastic member in each section shown in the FIG. 11 will be described with reference to the FIGS. 7 to 10.

FIGS. 7 and 8 showing the state of the guide member 500 in the process where the home bar door 160 is opened, correspond to ①-② section in the FIG. 11.

Specifically, the state as in the FIG. 7 is the state where the hosing 300 is fixed to the inner side of the home bar door 160, and one end of the main shaft 420 is fixed to the opening part 140 of the door 120 of the refrigerator. And, the housing 300 is rotated about the shaft 400 according to the rotation of the home bar door 160. And, in the inner side of the housing 330 the second elastic member 460 and the first elastic member 540 are normal states, that is, the states where the second elastic member 460 and the first elastic member 549 are not compressed by the main shaft 420 and the guide member 500, respectively.

Meanwhile, when the user grips the home bar door 160 and then, rotates it downwardly in order to open the home bar door 160, the housing 300 coupled to the home bar door 160 is rotated about the shaft 400. At this time, in the state where the home bar door 160 is completely opened, the housing 300 is rotated by approximately 90° to become the state as shown in the FIG. 8.

When the home bar door 160 is rotated (forward rotation) while being opened, a guide projection 520 is moved along the first guide groove 382 of the track groove 380. At this time, since the guide member 500 is not axially moved, it is not subject to the external force by mean of the first elastic member 540. Accordingly, since the user can easily open the home bar door 160 with applying large force, the home bar door 160 can be naturally operated.

Referring to the FIG. 1, in the state where the home bar door 160 is closed the guide projection is positioned at the ① position of the track groove 380, and passes the stationary section 385 according to the rotation of the home bar door 160 to be positioned at the ② position of the track groove 380.

At this time, the guide projection 520 passes through the latch 390, wherein if the guide projection 520 is contacted to the latch 390 in order to pass through the latch 390, the latch 390 is clockwise rotated (viewed from the FIG. 11). And, the guide projection 520 passes through the latch to be able to arrive at the ② position of the track groove 380.

Meanwhile, when the guide projection 520 passes through the latch 390 to arrives at the ② position of the track groove 380, the latch 390 is counterclockwise rotated by means of the elastic force of a built in elastic material to shield the first guide groove.

Accordingly, the guide projection 520 cannot be moved to the first guide groove 382 when being rotated (reverse rotation) for closing the home bar door 160, and is forcible moved along the guide groove 384 by means of the latch 390.

In the state where the home bar door 160 is opened, a food receiving work is performed, and when the receiving work is finished, the home bar door 160 is again rotated to shield the opening part 140.

To this end, the user performs the operation lifting up the home bar door 160 upwardly, and as the home bar door 160 is rotated (reverse direction), the housing 300 is also rotated together.

As shown in the FIG. 9, in order to the close the home bar door 160, the user must lift up the home bar door 160 until the angle of the home bar door 160 becomes approximately 45°, and the elastic member is compressed by means of such an operation.

Specifically, the guide projection 520 is moved along the second guide part 424 of the track groove 380 formed in the inner circumferential surface of the housing 300 according to the rotation of the housing 300. More specifically, the guide projection 520 is moved along the compressing section 386.

Since the compressing section 386 is curved in a length direction along the inner circumferential surface of the housing 300, when the housing 300 is rotated (reverse direction), the guide projection 520 is forcible moved. And, the guide member 500 is moved left (viewed from the FIG. 9) due to the movement of the guide projection 520.

As the guide member 500 is moved left, the first elastic member is gradually compressed until the guide projection 520 arrives at the ③ position of the track groove 380. When the home bar door 160 is upwardly rotated by approximately 45°, the guide projection 520 is positioned at the ③ position of the track groove 380. At this state, the guide member 500 becomes a state moved to the leftmost inside of the housing 300.

In such a state, when the home bar door 160 is slightly more upwardly rotated, the guide projection 520 passes through the compressing section 386 along one side of the second guide part 424 of the track groove 380 to enter the returning section 387. That is, when the guide projection 520 passes through the ③ position, which is the left end of the track groove 380, it passes through the compressing section 386 to enter the returning section 387.

In the FIG. 10, there is shown the hinge 200 in the state where it is rotated (reverse direction) by approximately 60° in order to close the home bar door 160.

In this process, the guide projection 520 is moved along the second guide part 424 of the track groove 380, specifically the returning section 387.

When the guide projection 520 is positioned at the returning section 387, the restoring force of the first elastic member 540 is transferred to the guide member 500. And, the guide member 500 is moved right along the guide part 424 of the main shaft 420 by means of the restoring force of the first elastic member 540.

At this time, sine the returning section is formed from the left to the right, the guide member 500 is smoothly moved by means of the elastic force of the first elastic member 540. And, the housing 300 is naturally rotated by means of the guide projection 520 moving along the returning section 387 so that it is rotated in the direction where the home bar door 160 is closed.

That is, although force is not applied from the outside in the instance when the guide projection 520 enters the returning section 387, the guide member 500 is forcible moved in an axial direction by means of the elastic force of the first elastic member 540. And, the housing 300 is forcibly rotated by means of the guide projection 520 moving along the shape of the track groove 380 formed in the inner circumferential surface of the housing 300.

When the first elastic member 540 is tensioned to become a normal state, the housing 300, the housing 300 finishes the rotation (reverse direction), and the home bar door 160 shields the opening part 140. At this time, the guide member 500 is completely moved right, and the guide projection 520 of the guide member 500 is again returned to the ① position of the track groove 380. Here, the movement of the guide projection 520 from the ③ position the ① position of the track groove 380 is done by means of the elastic force of the first elastic member 540, that is, it is not done by means of the external force applied by the user, but is automatically done.

The embodiment according to the present invention can be variously carried out besides the foregoing preferred embodiments, and hereinafter, the representative other embodiment will be described with reference to the accompanying drawings.

Of course, most of the constitutions of other embodiments to be described hereinafter are similar to the foregoing preferred embodiment in many portions and thus, the detailed description on the same portions will be omitted and the same reference numerals thereon will be used.

FIG. 12 is an exploded perspective view of the hinge according to another embodiment of the present invention, FIG. 13 is a cross-sectional view taken along I-I of FIG. 12, the state where a guide ring is safely positioned in the housing being shown, and FIG. 14 is a perspective view schematically showing an appearance adopted the door provided with the hinge in the refrigerator.

Referring to the FIGS. 12 to 14, the hinge 200 according to the present embodiment is characterized in that a separate guide ring 600 is inserted into the inside of the housing 300.

Specifically, the inner side of the housing 300 is provided with the ring mounting part 370 to which the guide ring 600 safely attaches. The ring mounting part 370 is formed to be depressed at a predetermined depth at the inner circumferential surface of the housing 300. More specifically, the ring mounting part 370 is formed to have the inner diameter corresponding to the outer diameter of the guide ring 600, so that the guide ring 600 is not fluctuated in the stage safely attached to the ring mounting part.

Also, the inner side of the ring mounting part 370 is further provided with the track groove projecting part 372, and the guide ring 600 has the shape same as the track groove projecting part 372 and is provided with a track groove perforating part 620 having the shape larger than the track groove projecting part 372. And, the ring mounting part 370 is positioned inside the track groove perforating part 620, and the edge part of the track groove perforating part 620 and the edge part of the track groove perforating part 620 is spaced by a predetermined interval to form the track groove 380. And, the degree of space corresponds to the diameter of the guide projection 520. Therefore, the guide projection 520 is moved along the track groove 380 formed between the track groove perforating part 620 and the track groove perforating part 620.

Meanwhile, the inner one side of the housing 300, more specifically, the one side of the track groove projecting part 372 is provided with the latch 390 selectively shielding one side of the track groove 380. The latch 390, which does not allow the guide projection 520 to be moved in the reverse direction when the home bar door 160 is completely opened, can forcibly move the guide projection 520 in one direction along the track groove 380 formed in a close loop shape. The content of this was described above and thus the description thereof will be omitted.

Meanwhile, the hinge according to the present invention can be variously modified, in addition to the foregoing embodiments.

For example, the shaft 400 can be fixed to the side of the home bar door 160, and the housing 300 can be mounted in the inner side of the opening part 140, that is, one side of the door 120 of the refrigerator.

And, the shape of the track groove 380 can be modified into the close loop shape, rather than a symmetrical shape. In this case, the compressing section of the first elastic member 540 and the section automatically rotated by means of the elastic force of the first elastic member 540 can be differently set by modifying the shape of the track groove 380, as describe above.

In addition, the hinge as described above can be applied to all kinds of doors rotated by means of opening and closing operation. For example, it can be applied to the door of a washer, the door of a dish washer, the door of an oven, etc., as well as the door of an automobile.

Referring to the FIG. 14, the hinge 200 provided in the door 200 of the refrigerator is shown.

The door 120 of the refrigerator is constituted by a left door and a right door, wherein the each of the doors is constituted to be able to be rotated, thereby selectively shielding the inner space of the body 100 of the refrigerator.

To this end, the upper and the lower of the left and light ends of the door 120 of the refrigerator are provided with the hinges 200. At this time, the housing 300 of the hinge 200 is provided in the inner side of the door 120 of the refrigerator, and the ends of the shaft 400 of the hinge 200 are projected to the upper end and the lower end of the door 120 of the refrigerator to be coupled to one side of the body 100 of the refrigerator.

Therefore, the housing 300 is rotated according to the rotating operation for opening and closing the door 120 of the refrigerator, and the door 120 of the refrigerator is automatically closed in a certain section by means of the first elastic member 540 provided in the inside of the hinge 200.

Industrial Applicability

With the hinge according to the present invention, if force is applied only up to a certain section in the closing process of the door, the door is automatically closed so that convenience of use is improved and industrial applicability is very high.

The invention claimed is:

1. A hinge including:

a housing;

a shaft received in the inside of the housing, a portion of the shaft extending outside of the housing;

a guide member linearly moving along the shaft; and a first elastic member compressed and expanded along the movement of the guide member, wherein any one of the guide member and the housing is formed with a track groove and the other is formed with a guide projection moving in the track groove, wherein the track groove is formed to move the guide projection to different paths according to a forward rotation and a reverse rotation of the shaft, and wherein the track groove includes a latch pivotally connected at one side thereof to allow the guide projection to move from one of the paths to another of the paths according to the forward rotation and reverse rotation of the shaft.

2. The hinge as claimed in claim 1, wherein the track groove includes:

a first guide groove formed in the rotating direction of the guide projection; and a second guide groove connecting both ends of the first guide groove and formed to be curved in the axis direction of the shaft.

3. The hinge as claimed in claim 1, wherein the shaft includes:

a main shaft in a flat key shape formed by chamfering a part thereof; and a sub shaft extendedly formed in the rear end of the main shaft.

4. The hinge as claimed in claim 3, further comprising a second elastic member fitted in the outer circumference of the sub shaft to allow the shaft to be closely attached to one side of the housing opposite the portion of the shaft extending outside of the housing, the second elastic member and the main shaft are received in the inside of the first elastic member.

5. The hinge as claimed in claim 1, wherein the housing is fixed in any one of a rotating object and a body rotatably coupled with the rotating object, and the shaft is projected from one side of the housing to be inserted into the other of the rotating object and the body.

6. The hinge as claimed in claim 5, wherein the rotating object comprises a door selectively shielding inner space.

7. A hinge including:

a housing fixed in any one of a rotating object and a body coupled with the rotating object;

a shaft received in the inside of the housing, a part of the shaft being projected to be inserted in the other one of the rotating object and the body;

a guide member inserted in an outer circumference of the shaft, the guide member moving in a linear direction during an opening and closing process of the rotating object;

a guide projection formed on the outer circumferential surface of the guide member;

a track groove projection part projected from an inner circumference surface of the housing;

a guide ring inserted into the inner circumference surface of the housing, the guide ring being provided with a track groove perforating part having a larger shape than the track groove projecting part such that the track groove projection part is received within the track groove perforating part to define a track groove to receive the guide projection; and an elastic member inserted inside the housing and expanded and contracted in the opening and closing of the rotating object.

8. The hinge as claimed in claim 7, wherein the track groove is formed to guide the movement of the guide projection in a forward rotation and a reverse rotation processes of a rotating object.

9. The hinge as claimed in claim 8, wherein the track groove includes:

a stationary section allowing the guide member to maintain a stationary state with respect to the housing in the forward rotation process of the rotating object;

a compressing section axially extended from the one end of the stationary section to allow the guide member to compress the elastic member by means of the movement of the guide projection in the reverse rotation of the rotating object; and a returning section extended from the end of the compressing section to the other end of the stationary section to return the elastic member by means of the movement of the guide projection.

10. The hinge as claimed in claim 9, wherein force is applied to rotate the rotating object in the compressing section and the rotating object is automatically rotated by means of the restoring force of the elastic member.

11. The hinge as claimed in claim 7, wherein the rotating object includes a door of a refrigerator, a home bar door of a refrigerator, a room door, a door of a washing machine, a door of a dryer, a door of a dish washer, a door of an oven, a door of a car.

12. The hinge as claimed in claim 7, wherein the rotating object includes a door selectively shielding an inner space formed in a body.

13. The hinge as claimed in claim 7, wherein the guide projection moves along the track groove formed by the track groove projecting part and the track groove perforating part.

14. A hinge including;

a housing;

a shaft received in the inside of the housing, a portion of the shaft extending outside of the housing;

a guide member moving along the shaft and having a guide projection projected on an outer circumferential surface thereof;

an elastic member compressed and expanded according to the movement of the guide member; and a guide ring mounted in an inner circumferential surface of the housing and having a perforating part formed therein for receiving the guide projection, the inner circumferential surface of the housing being formed with a projecting part received in the inside of the perforating part and formed with a track groove guiding the movement of the guide projection.

15. The hinge as claimed in claim 14, wherein the projecting part includes a latch pivotally connected at one sider thereof to forcibly move the guide projection in one direction of the track groove.

16. The hinge as claimed in claim 14, wherein the inner circumferential surface of the housing is formed with a step difference part to mount the guide ring and the projecting part is formed in the step difference part.

17. The hinge as claimed in claim 14, wherein the track groove is a closed loop shape.

18. The hinge as claimed in claim 14, wherein the elastic member is a tension spring.

* * * * *